US005339576A

United States Patent [19]

Fussler

[11] Patent Number: 5,339,576

[45] Date of Patent: Aug. 23, 1994

[54] SYSTEM OF MODULABLE WALLS

[75] Inventor: Philippe Fussler, Strasbourg, France

[73] Assignee: Steelcase Strafor (S.A.), Strasbourg, France

[21] Appl. No.: 983,726

[22] Filed: Dec. 1, 1992

[30] Foreign Application Priority Data

Aug. 10, 1992 [EP] European Pat. Off. ..... 92440096.3

[51] Int. Cl.[5] ..... E04B 7/16

[52] U.S. Cl. ..... 52/71; 52/282.1; 52/239; 160/135

[58] Field of Search ..... 52/281, 282.1, 239, 52/282.5, 71, 586; 160/135, 199, 351, 229.1, 231.1, 231.2

[56] References Cited

U.S. PATENT DOCUMENTS

| | | | |
|---|---|---|---|
| 2,210,652 | 8/1940 | Dennett | 160/231.1 |
| 3,345,439 | 10/1967 | Everard et al. | 264/26 |
| 3,493,449 | 2/1970 | Krug | 156/79 |
| 3,592,289 | 7/1971 | Aysta et al. | 160/135 |
| 3,895,670 | 7/1975 | Bales et al. | 160/135 |
| 4,344,475 | 8/1982 | Frey | 160/135 |
| 4,596,098 | 6/1986 | Finkbeiner et al. | 52/239 |
| 4,611,448 | 9/1986 | De Long | 52/239 |
| 5,048,585 | 9/1991 | Miller | 160/351 |

*Primary Examiner*—Carl D. Friedman
*Assistant Examiner*—Kien Nguyen
*Attorney, Agent, or Firm*—Mason, Fenwick & Lawrence

[57] ABSTRACT

A modulable wall system is shown including panels that are flexibly hinged to each other along vertical main frame sections. Each individual panel consists of a flat core made of a light material and is peripherally limited by a rigid area. The rigid area is provided for connecting vertical main frame sections to upper and lower horizontal main frame sections. The vertical main frame sections have grooves along their vertical sides for linking and hinging with adjacent panels and the lower horizontal main frame sections have support feet threadedly connected thereto.

11 Claims, 6 Drawing Sheets

SYSTEM OF MODULABLE WALLS

This invention relates to a new system of modulable walls, especially designed to take various shapes for the creation of personalized spaces in so-called "Landscape offices".

Many systems of this kind are known but they have various drawbacks: lack of charm and of aesthetic, despite their high cost, lack of stability, lack of attraction, being cold and stiff.

The invention obviates all these drawbacks, thanks to a new article, simple, cheap and of pleasant use.

To this effect the invention provides a modulable wall system for professional use comprising, in a known manner, panels hinged ones with the others around flexible vertical areas, with as a new feature, the fact that each individual panel consists in a flat core made of a light material, peripherally limited by a rigid area provided for catching frame elements having along their vertical sides means for linking and hinging with the next panels and resting means along their lower horizontal side.

Several modifications of this invention can be carried out with their various specific advantages.

According to a first modification the flat core consists in two plates of an expanded synthetic material, e.g. polyurethane, said two plates being assembled back to back and covered by a thin flexible sheet of spongy material with a decorative surface, said frame elements being under the form of sections hooked into longitudinal grooves in each face of the core rigid area, parallel to each edge.

Such a flat core can be built along a known process such as described in U.S. Pat. No. A-3,345,439 and U.S. Pat. No. A-3,493,449. In said known so-called overcasting process, the peripheral areas of the panel are over-densified, less porous and therefore more rigid than the remaining portion of the core, which allows on the one hand to assemble back to back the two plates forming the panel, and on the other hand to provide said panel with moulded grooves strong enough to receive the sections forming the frame, hooked thereto.

According a second modification which is simpler and cheaper, the flat core consists in a plate made of agglomerated fibers on which is downwardly slipped a cover element made of a spongy thin and flexible sheet and provided with a surface decoration, said cover element slipped down on said core over an additional frame made of plastic sections comprising grooves in which the main frame elements are hooked, which maintain therefore the cover by pinching.

Both modifications comprise additional common features: one of said common features is the provision of angle elements joining the frame elements. Said angle element is a moulded piece comprising studs at right angles each others designed to be inserted into the respective ends of said sections. The lower angle elements comprise threads for screwing adjustable feet for the panel.

Another common feature is the provision of a central groove in said main frame sections, said groove being designed to receive either a vertical flexible joining band or an horizontal rib of a stabilizing base for one panel or for the complete wall.

In the second modification, it is provided means for fixing the lower edges of the cover, said means consisting in a stem forced together with said edges into a groove of the corresponding additional frame plastic segment.

The main frame sections and the angle elements can be made of metal or of plastic.

The invention will now be described in detail with reference to the attached drawings, on which:

Figure 1:
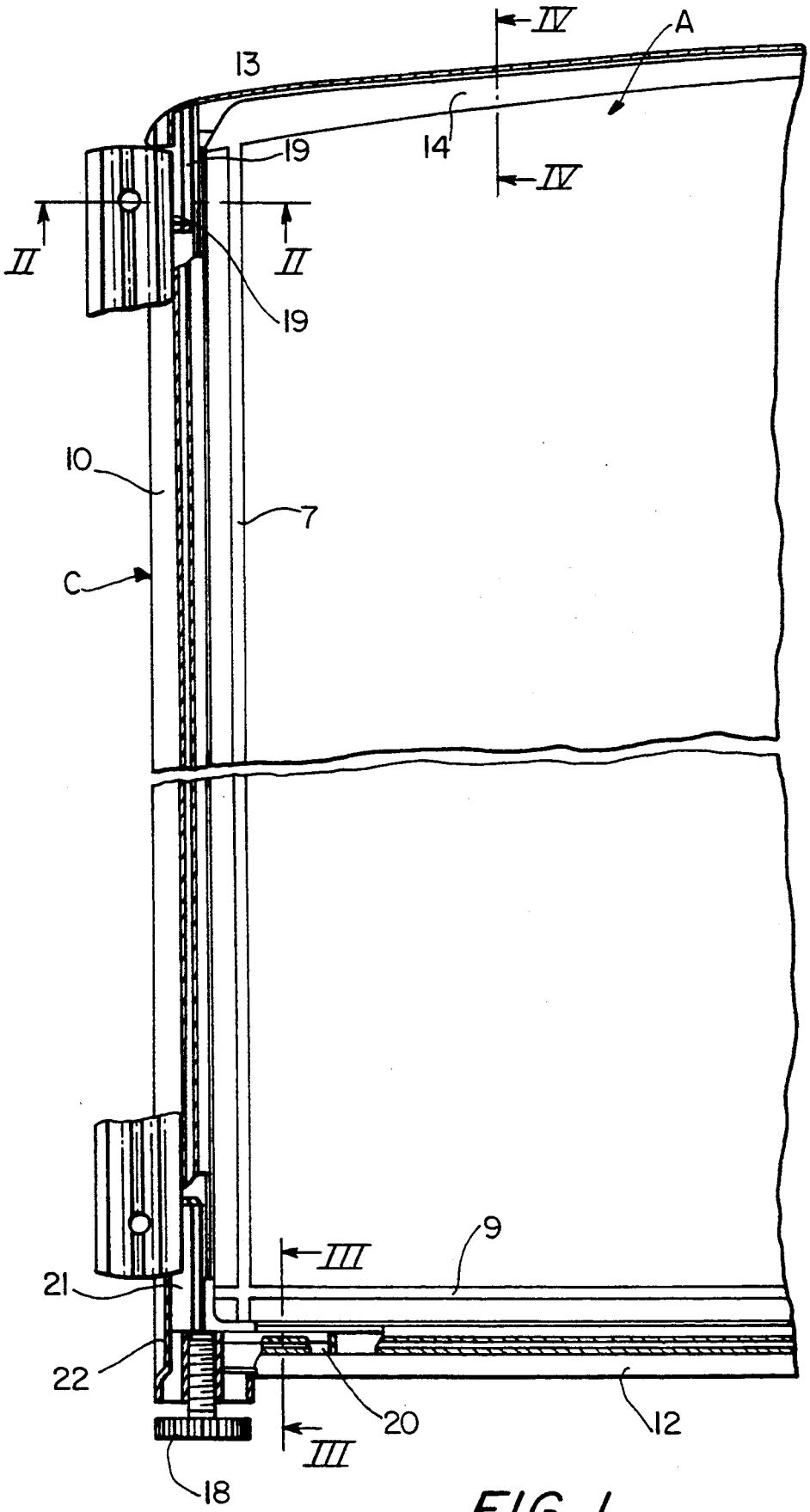
FIG. 1 is a front view of an example of the first modification of the invention with two back to back plates of expanded polyurethane, forming an individual panel.

Referring first to FIGS. 1 to 5, it is shown a panel according to the first modification of the invention, comprising a central portion or core A and a peripheral frame C.

In this modification, the core A comprises two flat plates 1, 2, each made by overcasting expanded polyurethane upon a back made of a spongy flexible sheet 3, 4 covered with a decorative fabric 5, 6, both plates 1, 2 being assembled back to back by sticking, pinching or any similar way such as both visible faces of the case A show the decorative fabric 5, 6.

Parallel to each vertical edge of the panel, each external face of the plates 1, 2 is provided with a groove 7, 8, and parallel to the lower horizontal edge of the panel, the external face of the plates 1, 2 is provided with a groove 9, said grooves 7, 8, 9 being at a short distance of the edges, e.g. 2–4 cm and being formed when the core is overcast upon the back.

Figure 2:
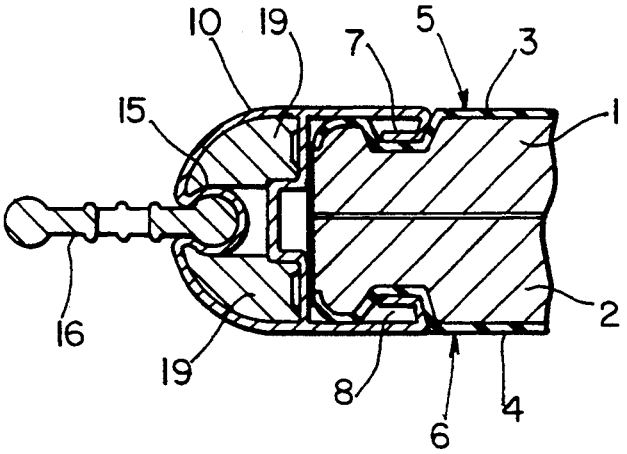
FIG. 2 is a partial horizontal section along II—II of FIG. 1.
Figure 3:
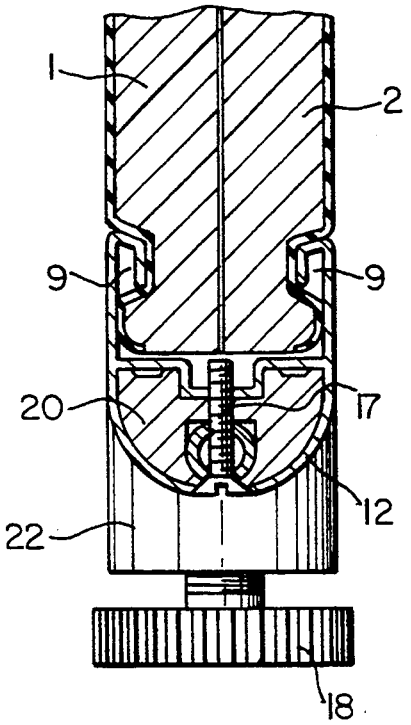
FIG. 3 is a partial vertical section along III—III of FIG. 1.
Figure 4:
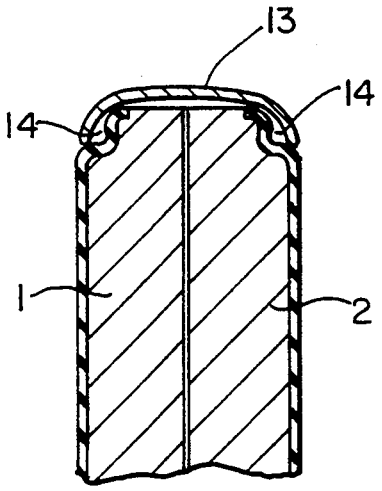
FIG. 4 is a partial vertical section along IV—IV of FIG. 1.
Figure 6:
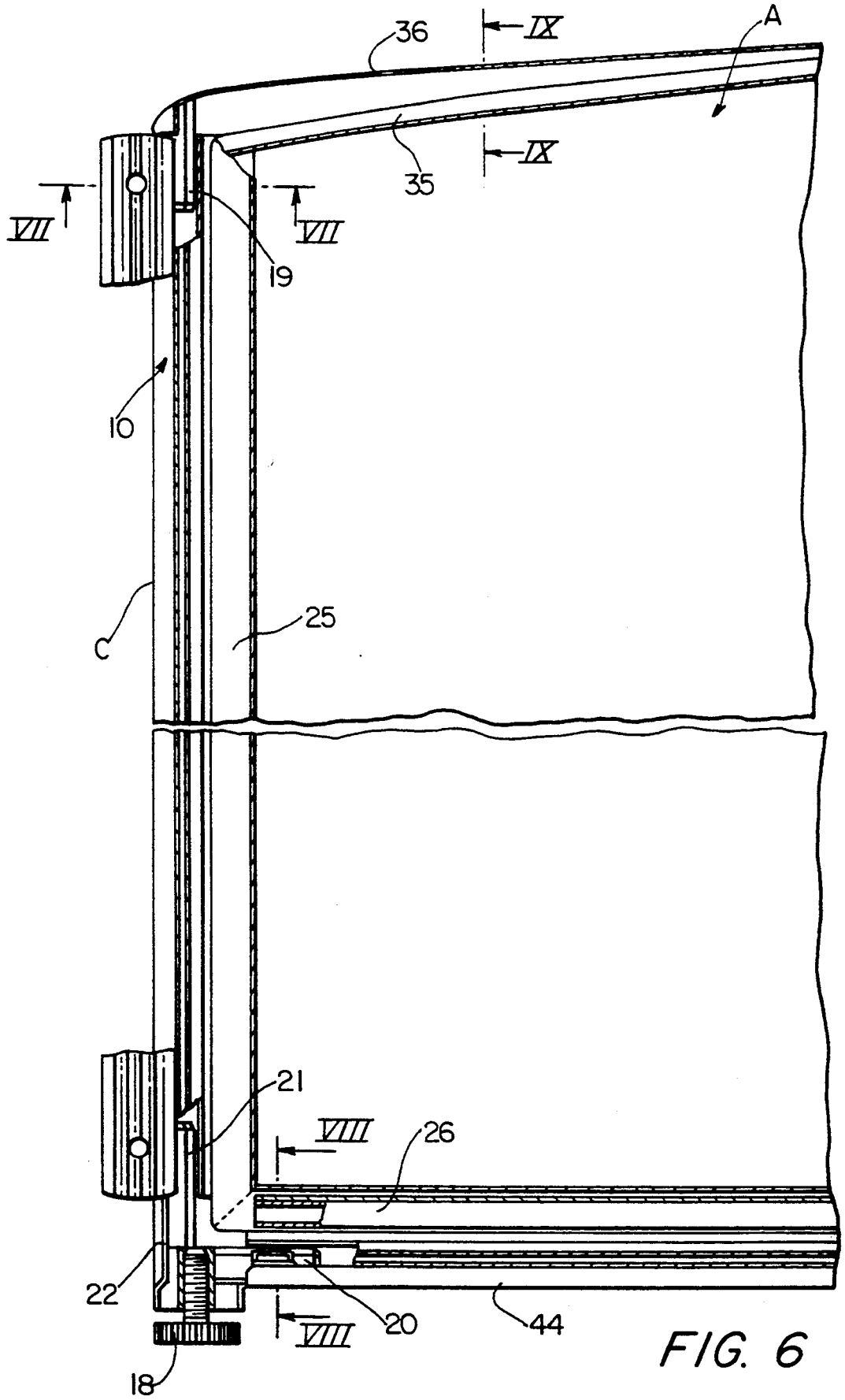
FIG. 6 is a front view of an example of the second modification of the invention with a panel of agglomerated fibers and a frame made of PVC sections.
Figure 7:
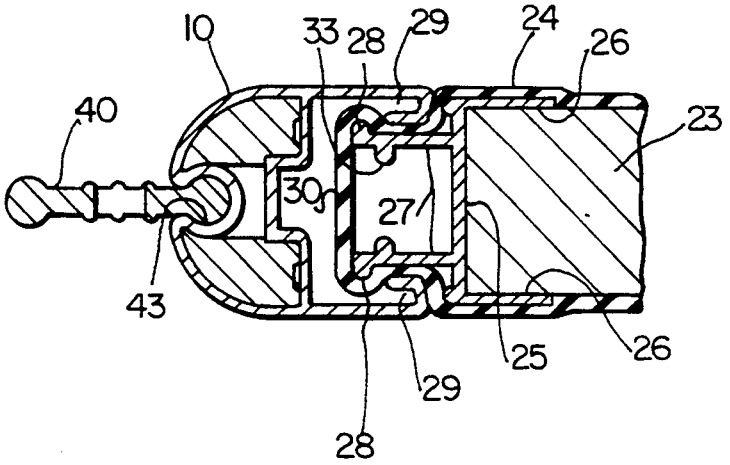
FIGS. 7, 8,9 and 10 are similar to FIGS. 2, 3, 4 and 5 for the panel of FIG. 6.

As shown on FIGS. 2 and 3, said grooves 7, 8, 9 are used for hooking, upon the corresponding edges of the core, of the three elements 10, 11, 12 or the frame C, which consist in sections, e.g. of aluminium. Along the fourth edge of the core, i.e. the upper edge, which is slightly convex, the fourth section 13 of the frame is a U section of plastic, pinching to side grooves 14 of the plates 1, 2 edges (FIG. 4).

Figure 5:
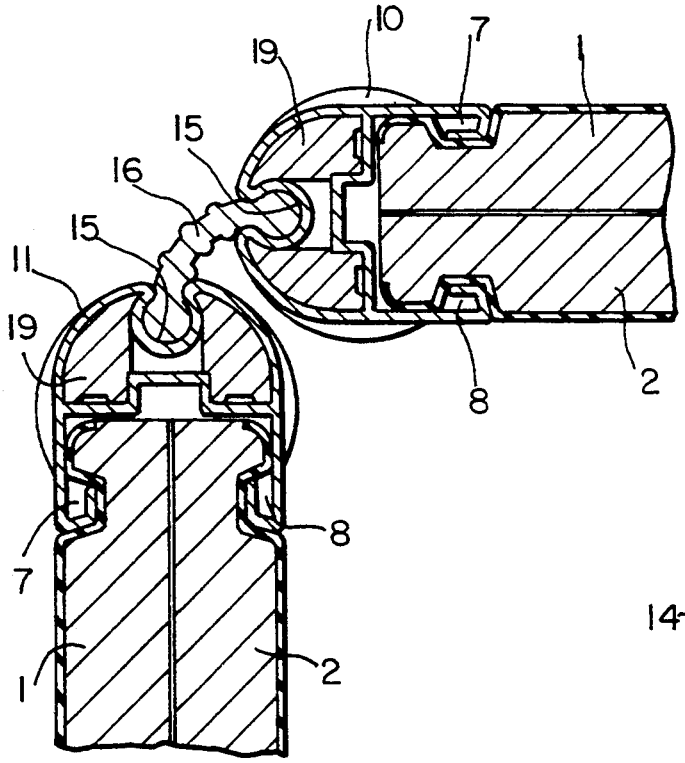
FIG. 5 is a partial horizontal section of the assembly of two panels as shown on FIGS. 1–4.

Each vertical section 10, 11 is of U shape, the branches thereof are elastically hooked or slipped in the grooves 7, 8, and the base thereof is shaped as a longitudinal groove 15 in which is inserted an edge of a flexible band 16 used as an hinge between two successive panels (Fig. 5).

The lower horizontal section 12 has also a U shape with a groove 15, at each end thereof is screwed a threaded foot 18 (FIG. 3).

It is clear that, due to this structure of the panel, the frame C is at a level with the faces of the core 1, 2.

It is also understood that the process so-called overcasting used for making the core A is already known and used for making articles in other technical fields, e.g. pieces for the car industry. However this process had never been used for making framed cores as in this invention.

The plates 1, 2 are of expanded material, and consequently very light, but in this overcasting process the superficial portions and the edges, comprising the grooves 7, 8, 9, are "over-densified", or less porous, and more strong, which allows the hooking of the sections 7, 8, 9.

Finally, as shown on FIG. 1, the ends of the upper section 13 comprise vertical studs 19, integral with the section, and which are inserted into the vertical sections ends 10, 11; said vertical sections 10, 11 are joined at their lower ends with the lower horizontal section 12 by angle elements 22 (FIG. 11) comprising horizontal studs 20 and vertical studs 21 forced into the sections ends and used as braces.

Figure 11:
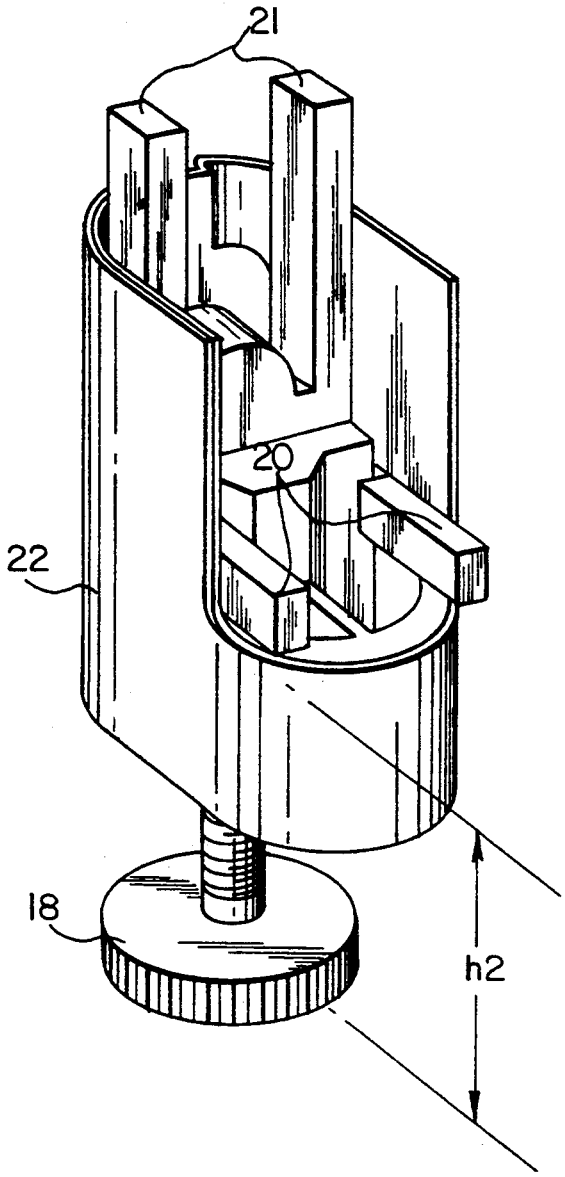
FIG. 11 is a perspective view of an angle element used in the main frame of a panel according to the invention.

Said braces are vertically threaded to accommodate the screwed feet 18. FIG. 11 shows such a brace, in perspective with its stud, the screwed foot 18 being in place. Said brace 22 is blocked into the vertical section 10 with a vertical screw 17 (FIG. 3).

Referring now to FIG. 6 to 10, it is shown a second modification of the invention, with the same numerals for the corresponding elements.

The panel of the invention still comprises a core A and a frame C, but the structure of the core A is different.

In this modification, said core A is made of an unique plate of agglomerated particles 23, such as wood fibers agglomerated by a synthetic resin, e.g. PVC; upon this plate in slipped downwardly a cover or sheath 24 made of a flexible spongy or porous sheet with a decorative surface.

The frame C is similar to the frame of the first modification. However, the plate 23 does not comprise grooves such as 7, 8, 9, so that, with a view to hook said frame C to the core A, the plate 23 must be provided, before slipping of the sheath 24, with an additional frame made of plastic sections 25, e.g. of PVC, having a shape of two U joined along their bases, the branches 26 of the first U pinching the edge of the plate 23 and the branches 27 of the second U being closer and having external rims 28 and internal rims 33, forming in the external surface of the second U two channels 29 adapted to receive the branches of the sections 10, 11, 12 of the main frame C, which are therefore hooked to the plate 23 and which maintain the sheath 24 into said channel 29.

Figure 8:
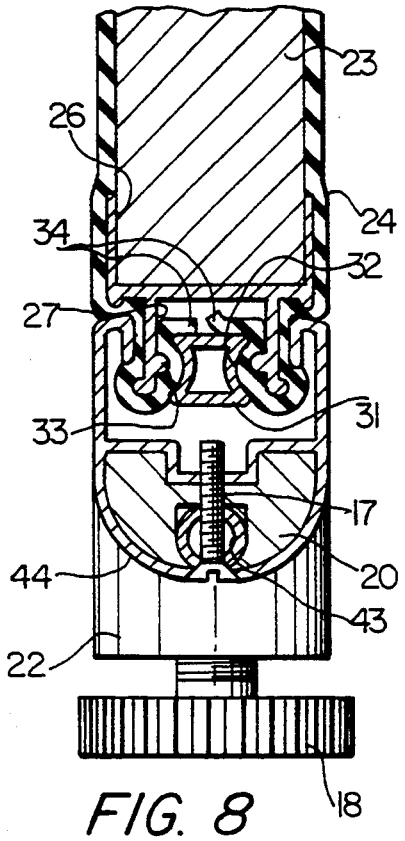
Figure 9:
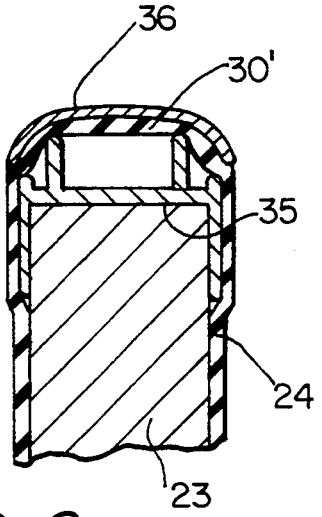

Considering that the cover 24 is a bag closed at its upper end and slipped downwardly on the plate 23, both faces of said cover are joined by a continuous portion 30 along the vertical edges (FIG. 7), and by a continuous portion 30 along the upper horizontal edge (FIG. 9). However the two lower edges 34 of said bag are free. To fix the same it is provided means to force said edges 34 into the base of the external U 27. Said means comprise a stem 31 having two grooves 32 which receive the internal rims 33 of the branches of the U 27 (FIG. 8). Said stem 31 pushes and blocks therefore the edges of the bag 24 into the bottom of the U 27.

Figure 10:
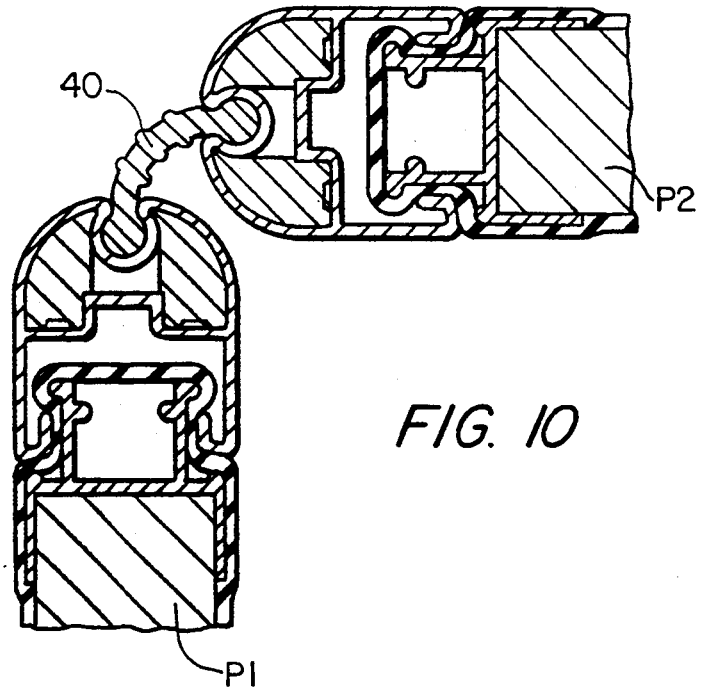

As shown on FIG. 10, similar to FIG. 5, two successive panels P1, P2 are joined by a flexible band 40 inserted in the vertical grooves of the corresponding vertical sections 10.

As shown by hatchings on FIGS. 7–10, the angles of each panel frame section are joined by braces the studs of which are forced into the sections ends, said braces being illustrated on FIG. 11. Said braces are also used for screwing the feet 41.

Figure 12:
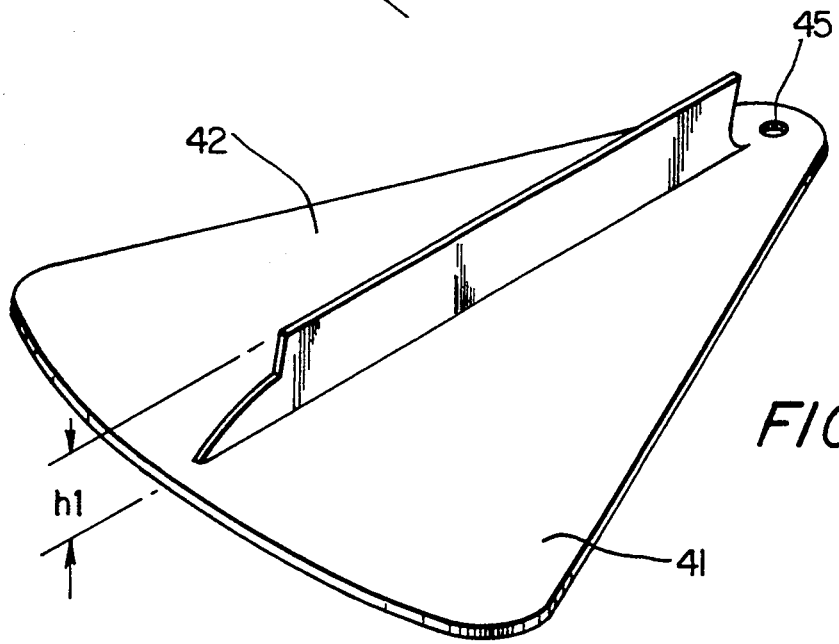
FIG. 12 shows a base for the panels of the invention.
Figure 13:
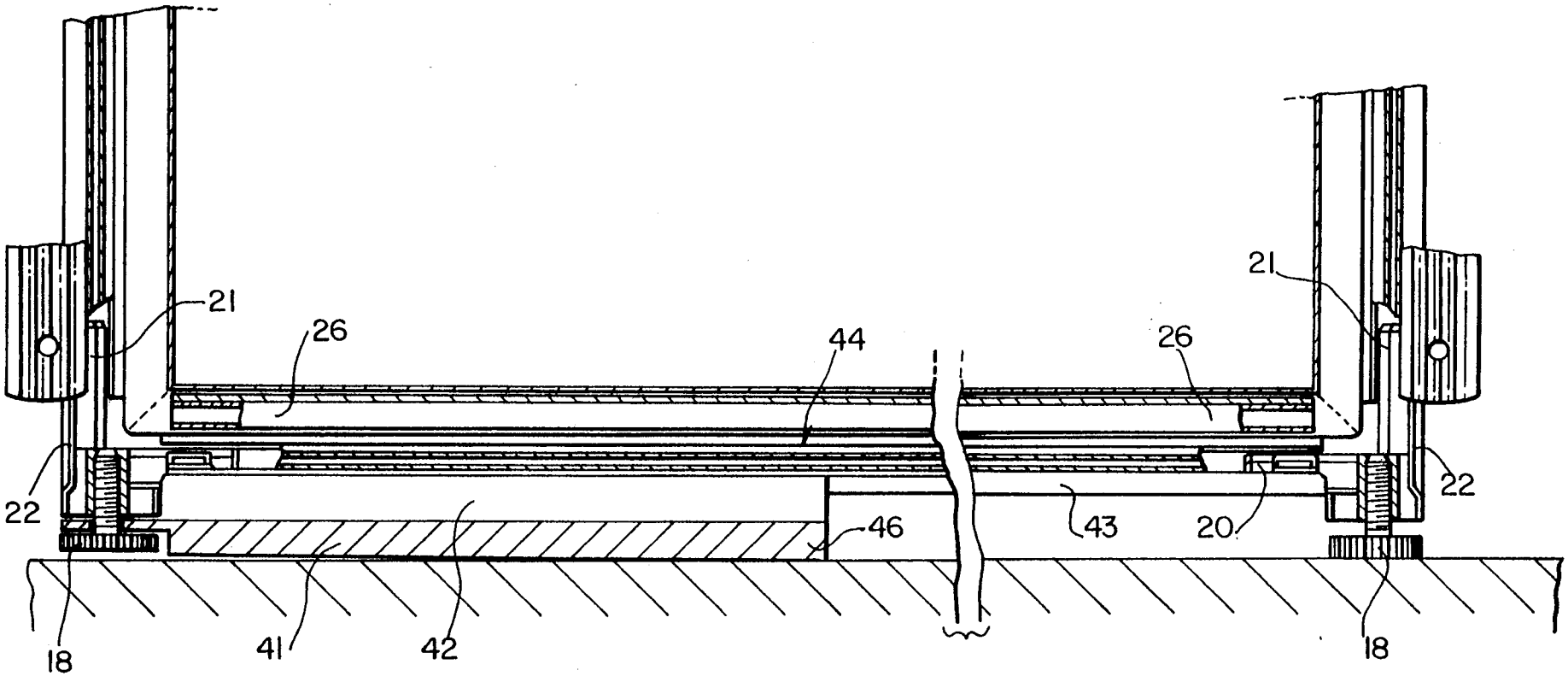
FIG. 13 is a vertical section of the lower part of a panel of the invention, resting upon a base as shown on FIG. 12 and upon a screwed foot.

FIGS. 12 and 13 show an example of a base provided to stabilize one or several vertical panels, especially when said panels are individuals or in line.

Such a base comprises an substantially horizontal plate 41 made of heavy material and having a vertical rib 42, the thickness of which is approximately equal to the width of the external groove 43 of the section 44 forming the lower edge of a panel (FIGS. 3 and 8).

The height H1, of said plate 41 with its rib 42 is higher than the height H2 of a foot 18 when fully screwed into a brace 22.

Referring to FIG. 13, it can be seen than when said rib 42, is fully inserted along the proove 43, the plate 41 is positioned symmetrically with respect, to the panel. When the foot 18 is fully screwed in the brace 22 after passing through a hole 45 in one end of plate 41 (FIG. 12), it is against the lower face of said plate 41, so that the base is locked against the panel lower edge, said foot 18 being slightly above the ground. The plate 41 is therefore slightly inclined with respect to the ground.

As shown on FIG. 13, such a base 41-42 is installed at one end only of a panel, the other end resting on the ground by the foot 18 screwed at the proper level into the brace 22. It can be appreciated that the panel rests on the ground by three points, i.e. both angles 46 of the plate 41 opposed to the hole 45, and the screwed foot 18, allowing the adjustment of the height and slope of the panel.

Such a stabilizing base provides a proper rest for an erected panel alone. However it should be appreciated that the panel of the invention is essentially adapted to the erection of composite walls of any shape by associating a number of panels along a sinuous path. In this case this base is only useful at the ends of said path, the intermediate panels resting on the ground by their respective feet 18 distributed along the overall twist of the path. In case said path is too straight, it is advisable to add one or more intermediate stabilizing bases.

I claim:

1. A panel for modulable walls of variable shape comprising:

a flat core of light material with a peripheral rigid portion;

a main frame hooked to said rigid portion, said main frame having vertical main frame sections for bringing successive panels together, and having upper and lower horizontal main frame sections wherein said lower horizontal main frame sections provide means for resting the panel upon the ground;

said flat core being made of an unique plate of agglomerated particles;

a cover made of a sheet of spongy material having an external decorative surface;

an additional frame comprising sections made of synthetic resin having a section in the shape of two opposed U's, the branches of a first U pinching edges of said panel and the branches of a second U including grooves parallel to edges of said panel for hooking to said main frame;

said cover being slipped downwardly over said panel and over said additional frame.

2. A panel for modulable walls of variable shape comprising:

a flat core of light material with a peripheral rigid portion;

a main frame hooked to said rigid portion, said main frame having vertical main frame sections for bringing successive panels together, and having upper and lower horizontal main frame sections wherein said lower horizontal main frame sections provide means for resting the panel upon the ground;

said flat core being made of an unique plate of agglomerated particles;

a cover made of a sheet of spongy material having an external decorative surface;

an additional frame comprising sections made of synthetic resin having a section in the shape of two opposed U's, the branches of a first U pinching edges of said panel and the branches of a second U including grooves parallel to edges of said panel for hooking to said main frame;

said cover being slipped downwardly over said panel and over said additional frame;

said second U portion of said additional frame having longitudinal rims extending inwardly from opposite inner surfaces on the branches of said second U; and a longitudinal stem member pressed in between said longitudinal rims and securing lower edges of said cover between said stem member and said longitudinal rims.

3. A panel as in claim 2 wherein braces are provided at a lower end of each of said vertical main frame sections, and said braces having studs inserted into said lower ends and studs inserted into said lower horizontal main frame sections for assembling said vertical main frame sections and said lower horizontal main frame sections into said main frame.

4. A panel according to claim 3 wherein said braces are provided with vertically oriented threaded bores for threadedly receiving support members.

5. A panel according to claim 4 wherein an upper horizontal main frame section comprises integral studs inserted into upper ends of said vertical main frame sections.

6. A panel according to claim 5 wherein each vertical main frame section comprises a vertical groove for receiving a flexible band for joining two successive panels.

7. A panel according to claim 6 wherein a lower horizontal main frame section comprises a longitudinal groove for receiving a rib of a stabilizing base member.

8. A panel according to claim 7 wherein said stabilizing base member supports said panel at a height which is higher than a minimum height at which said panel is supported by said support member.

9. A panel according to claim 2 wherein said cover sustains a slight strain when slipped over said panel as a result of having a total surface area before installation that is slightly smaller than a total surface area of said panel.

10. A panel according to claim 9 wherein said main frame and said braces are made of metal.

11. A panel according to claim 9 wherein said main frame and said braces are made of a synthetic resin.

* * * * *